US009557688B2

(12) United States Patent
Tajiri

(10) Patent No.: US 9,557,688 B2
(45) Date of Patent: Jan. 31, 2017

(54) IMAGE FORMING APPARATUS HAVING CONDUCTIVE SHEET GUIDE

(71) Applicant: CANON KABUSHIKI KAISHA, Tokyo (JP)

(72) Inventor: Tsuyoshi Tajiri, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,176

(22) Filed: May 26, 2015

(65) Prior Publication Data

US 2015/0338788 A1 Nov. 26, 2015

(30) Foreign Application Priority Data

May 26, 2014 (JP) ..... 2014-107691
Apr. 28, 2015 (JP) ..... 2015-091964

(51) Int. Cl.
*G03G 15/00* (2006.01)
*G03G 15/16* (2006.01)
*G03G 21/16* (2006.01)

(52) U.S. Cl.
CPC ..... *G03G 15/161* (2013.01); *G03G 15/00* (2013.01); *G03G 15/16* (2013.01); *G03G 15/1665* (2013.01); *G03G 21/16* (2013.01)

(58) Field of Classification Search
CPC ..... G03G 15/165; G03G 15/1665
See application file for complete search history.

(56) References Cited

U.S. PATENT DOCUMENTS 5,166,737 A * 11/1992 Tomita ..... G03G 15/657 399/400
5,283,116 A * 2/1994 Tomari ..... B41F 22/00 428/208
8,626,044 B2 1/2014 Ohba et al.
8,855,544 B2 * 10/2014 Namisaki ..... G03G 15/2085 399/397
2002/0131801 A1 9/2002 Tomatsu
2004/0253025 A1 12/2004 Matsuura
(Continued)

FOREIGN PATENT DOCUMENTS

JP 2001-022193 A 1/2001
JP 2003-345141 A 12/2003
(Continued)

OTHER PUBLICATIONS

JP_2011033761_A_I Machine Translation Feb. 17, 2011, Ueda.*
(Continued)

*Primary Examiner* — Minh Phan
*Assistant Examiner* — Victor Verbitsky
(74) *Attorney, Agent, or Firm* — Fitzpatrick, Cella, Harper & Scinto

(57) ABSTRACT

An image forming apparatus includes a transfer portion transferring a toner image to a sheet, and a sheet guide portion guiding the sheet to the transfer portion. The sheet guide portion includes a resin member and a conductive member. The conductive member is provided to be in contact with the sheet to which the toner image is being transferred by the transfer portion and on a surface of the resin member so as to be grounded through the resin member, and has a volume resistivity which is lower than that of the resin member.

13 Claims, 3 Drawing Sheets

(56) References Cited

U.S. PATENT DOCUMENTS

| | | | | |
|---|---|---|---|---|
| 2008/0122168 | A1* | 5/2008 | Higashimura | G03G 15/1605 271/275 |
| 2010/0239297 | A1* | 9/2010 | Sakaya | G03G 15/2053 399/69 |

FOREIGN PATENT DOCUMENTS

| | | | | |
|---|---|---|---|---|
| JP | 2008-134387 | A | | 6/2008 |
| JP | 2008134387 | A | * | 6/2008 |
| JP | 2011-033761 | A | | 2/2011 |
| JP | 2012-032487 | A | | 2/2012 |
| JP | 5198515 | B2 | | 5/2013 |

OTHER PUBLICATIONS

JP_2011033761_A_I Machine Translation, Japan, Ueda, Feb. 2011.*

Search Report issued in UK Patent Application No. GB1508797.6, dated Nov. 24, 2015.

* cited by examiner

IMAGE FORMING APPARATUS HAVING CONDUCTIVE SHEET GUIDE

BACKGROUND OF THE INVENTION

Field of the Invention

The present invention relates to an image forming apparatus adopting an electro-photographic recording system or the like such as a copier, a facsimile machine, a laser beam printer, and a multi-function printer.

Description of the Related Art

An image forming apparatus adopting an electro-photographic recording system such as a copier, a facsimile machine, a laser beam printer, and a multi-function printer includes a transfer structure transferring a toner image formed on an image carrier such as a photosensitive drum and an intermediate transfer belt to a sheet-like recording medium (referred to simply as a 'sheet' hereinafter). A transfer structure disclosed in Japanese Patent No. 5198515 includes an image carrier and a transfer member such as a transfer roller being in contact with the image carrier and forming a transfer nip portion.

The transfer structure disclosed in Japanese Patent No. 5198515 includes a metal plate guiding the sheet to the transfer nip portion. A variable resistor (resistive element) is provided on a path of a grounding wire extending from the main guide portion.

If no variable resistor is interposed, it is unable to restrain the electric current from flowing from the transfer member to the metal plate through the sheet. Thus, much current from the transfer member flows to the metal plate, and an amount of current which should originally flow from the transfer member to the image carrier decreases, causing defective transfer of the toner. The provision of the variable resistor permits to restrain the current from flowing from the transfer member, transferring the toner image, to the metal plate and to prevent the defective transfer of the toner. However, a more low cost apparatus has been desired.

SUMMARY OF THE INVENTION

According to a first aspect of the invention, an image forming apparatus includes a transfer portion transferring a toner image to a sheet and a sheet guide portion guiding the sheet to the transfer portion. The sheet guide portion includes a resin member made of resin and a conductive portion provided to be in contact with the sheet to which the toner image is being transferred by the transfer portion and on the resin member so as to be earthed through the resin member, the conductive portion having lower volume resistivity than that of the resin member.

Further features of the present invention will become apparent from the following description of exemplary embodiments with reference to the attached drawings.

DESCRIPTION OF THE EMBODIMENTS

Figure 1:
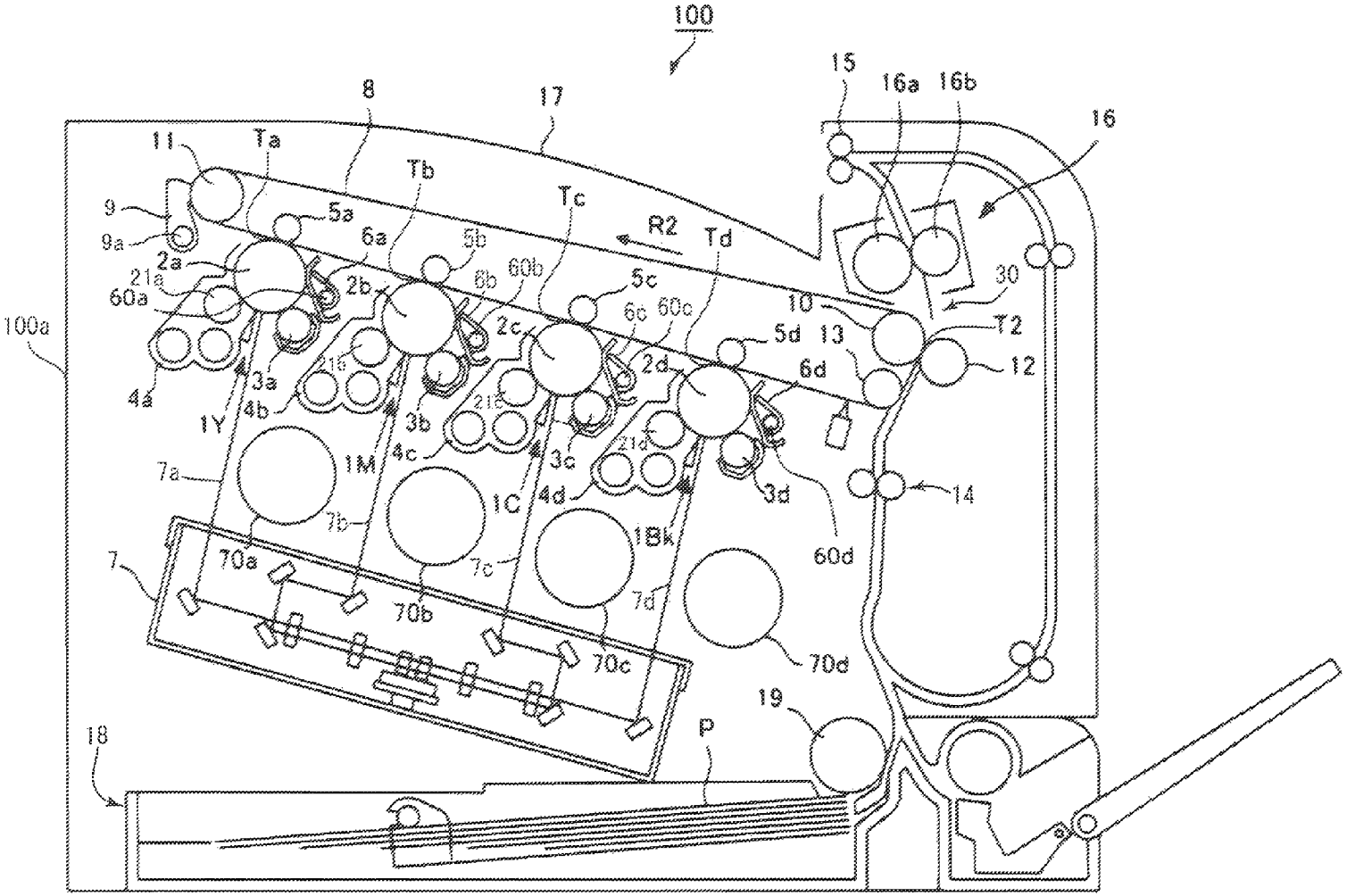
FIG. 1 is a schematic section view illustrating a configuration of an image forming apparatus according to an embodiment of the present invention.

An image forming apparatus according to an embodiment of the present invention will be described in detail with reference to the drawings. It is noted that the same reference numerals denote the same or corresponding components throughout the drawings. FIG. 1 is a schematic section view illustrating a configuration of the image forming apparatus according to the embodiment of the present invention.

<Image Forming Apparatus>

As shown in FIG. 1, the image forming apparatus 100 is a tandem-type intermediate transfer system full-color printer in which image forming portions 1Y, 1M, 1C, and 1Bk are arrayed along a straight section under an intermediate transfer belt 8 within an apparatus body 100*a* thereof.

In an image forming process, a yellow toner image is formed on a photosensitive drum 2*a* and is primarily transferred to the intermediate transfer belt 8 at a primary transfer portion Ta in the image forming portion 1Y. A magenta toner image is formed on a photosensitive drum 2*b* and is primarily transferred while being superimposed on the yellow toner image on the intermediate transfer belt 8 at a primary transfer portion Tb in the image forming portion 1M. In the same manner, cyan and black toner images are formed respectively on photosensitive drums 2*c* and 2*d* and are primarily transferred to the intermediate transfer belt 8 at primary transfer portions Tc and Td in the image forming portions 1C and 1Bk.

The four color toner images sequentially and primarily transferred to the intermediate transfer belt 8 are conveyed to a secondary transfer portion 30, i.e., a transfer portion, and are secondarily transferred collectively to a sheet P. Transfer residual toner left on the intermediate transfer belt 8 that has passed through the secondary transfer portion 30 is removed by a belt cleaning device 9.

The cleaning device 9 removes the transfer residual toner adhering on a surface of the intermediate transfer belt 8 that has passed the secondary transfer portion 30 by frictionally sliding a cleaning blade (not shown) to the intermediate transfer belt 8. The transfer residual toner removed by the cleaning blade is conveyed to a toner recovery container by passing through a toner conveying portion located inside of the apparatus body 100*a* by a toner conveying screw 9*a* of the cleaning device 9.

The sheet P on which the four color toner images have been transferred is heated and pressurized by a fixing apparatus 16 to fix the toner images on a surface of the sheet P and is then discharged to a discharge tray 17. The fixing apparatus 16 includes a fixing nip composed of a fixing roller 16*a* including a heater and a fixing apparatus 16 brought into pressure contact with the fixing roller 16*a*. The sheet P receives heat and pressure and the toner images are melted in a process of being nipped and conveyed through the fixing nip. Thus, the toner images are fixed as a full-color image.

a sheet feed cassette 18 is stored and disposed at a lower part of the apparatus body 100*a*. A separation roller 19 separates the sheet P picked out of the sheet feed cassette 18 one by one and delivers to a registration roller pair 14. The registration roller pair 14 receives the sheet P in a stopped state and makes the sheet P standby. Then, the registration roller pair 14 delivers the sheet P to a secondary transfer portion 30 by synchronizing with the toner images on the intermediate transfer belt 8.

The image forming portions 1Y, 1M, 1C, and 1Bk have the same configuration, with the exception of the colors of toners used in developing apparatuses 4*a*, 4*b*, 4*c*, and 4*d* attached thereto. Then, the following description will be described centering on the image forming portion 1Y located at a most upstream side in the flow of the image forming process, and the other image forming portions 1M, 1C, and 1Bk will be described by replacing a tag of reference numerals within the description from a to b, c, and d.

The image forming portion 1Y includes a charging apparatus 3*a*, a developing apparatus 4*a*, a primary transfer roller 5*a*, and a cleaning device 6*a* provided around the photosensitive drum 2*a*. The image forming portion 1Y including the photosensitive drum 2*a*, the developing apparatus 4*a*, and others is arranged as a process cartridge for its maintenance.

The photosensitive drum 2*a* is formed of a metallic cylinder in which a photosensitive layer whose electrification polarity is negative is formed on a surface thereof, receives a driving force from a driving motor (not shown), and rotates clockwise in FIG. 1 with a predetermined process speed. In the charging apparatus 3*a*, an electrification roller is rotated while bringing the roller into pressure contact with the photosensitive drum 2*a* and voltage in which DC and AC voltages are superimposed is applied to the electrification roller to homogeneously electrify the surface of the photosensitive drum 2*a*.

A laser 7*a* is irradiated from the exposing apparatus 7 to the photosensitive drum 2*a*. That is, the exposing apparatus 7 scans a laser beam of ON-OFF modulated scan line image data developed from a color separation image of yellow by a polygonal mirror and draws an electrostatic image of the image on the electrified surface of the photosensitive drum 2*a*. The exposing apparatus 7 includes a laser emitting portion emitting the laser beam corresponding to a time-series electric digital image signal of given image information, the polygonal lens, a reflection mirror and others.

The developing apparatus 4*a* reversely develops the electrostatic image by adhering negatively electrified toner to an exposed portion of the electrostatic image on the photosensitive drum 2*a*. The developing apparatus 4*a* rotates a development sleeve 21*a* carrying the toner in a counter direction to the photosensitive drum 2*a* centering on a fixed magnetic pole and applies development voltage in which the AC voltage is superimposed on the negative DC voltage to the development sleeve 21*a* from a power source (not shown).

The primary transfer roller 5*a* is in pressure contact with the photosensitive drum 2*a* through the intermediary of the intermediate transfer belt 8 and forms a primary transfer portion Ta between the photosensitive drum 2*a* and the intermediate transfer belt 8. The toner image is primarily transferred to the intermediate transfer belt 8 by positive DC voltage applied from the power source (not shown)to the primary transfer roller 5*a* in a process when the intermediate transfer belt 8 passes through the primary transfer portion Ta while superimposing the toner images negatively electrified.

Toner bottles 70*a*, 70*b*, 70*c*, and 70*d* are disposed above the exposing apparatus 7. The toners consumed in the developing apparatuses 4*a*, 4*b*, 4*c*, and 4*d* to form an image on the sheet P are replenished from the toner bottles 70*a*, 70*b*, 70*c*, and 70*d*.

The cleaning device 6*a* removes transfer residual toner left on the surface of the photosensitive drum 2*a* after passing through the primary transfer portion Ta by frictionally sliding a cleaning blade on the photosensitive drum 2*a*. The removed toner is conveyed by a toner conveying screw 60*a* to a toner discharge portion (not shown).

The intermediate transfer belt 8 is stretched around the tension roller 11, the driving roller 10 and the stretch roller 13 and rotates in a direction of an arrow R2 by being driven by the driving roller 10. The intermediate transfer belt 8 is composed of dielectric resin such as polycarbonate, polyethylene-telephthalate resin film, and polyvinylidene fluoride resin film.

A secondary transfer portion 30 where the toner image is transferred to the sheet P is formed by bringing a secondary transfer outer roller 12 into contact with the intermediate transfer belt 8 whose inner side is stretched by the driving roller 10. That is, the secondary transfer portion 30 includes the intermediate transfer belt (image carrier) 8 carrying the toner image and the secondary transfer outer roller 12 forming a transfer nip portion T2 where the secondary transfer outer roller 12 nips the sheet P with the intermediate transfer belt 8 and to which transfer bias is applied.

That is, the secondary transfer outer roller 12 forms the transfer nip portion T2 by coming into contact with the intermediate transfer belt 8 wrapped around the driving roller 10 and applies the transfer bias to the driving roller 10 through the intermediate transfer belt 8. A toner image transfer electric field is formed in the secondary transfer portion 30 between the secondary transfer outer roller 12 to which positive DC voltage is applied from a power source (not shown) and the driving roller 10 connected to a ground potential.

<Secondary Transfer Portion and Peripheral Configuration Thereof>

Next, a configuration around the secondary transfer portion 30 will be described with reference to FIGS. 2A, 2B and 3. It is noted that FIGS. 2A, 3B and 3 are schematic diagrams illustrating the secondary transfer portion 30 and its vicinity of the present embodiment.

Figure 2A:
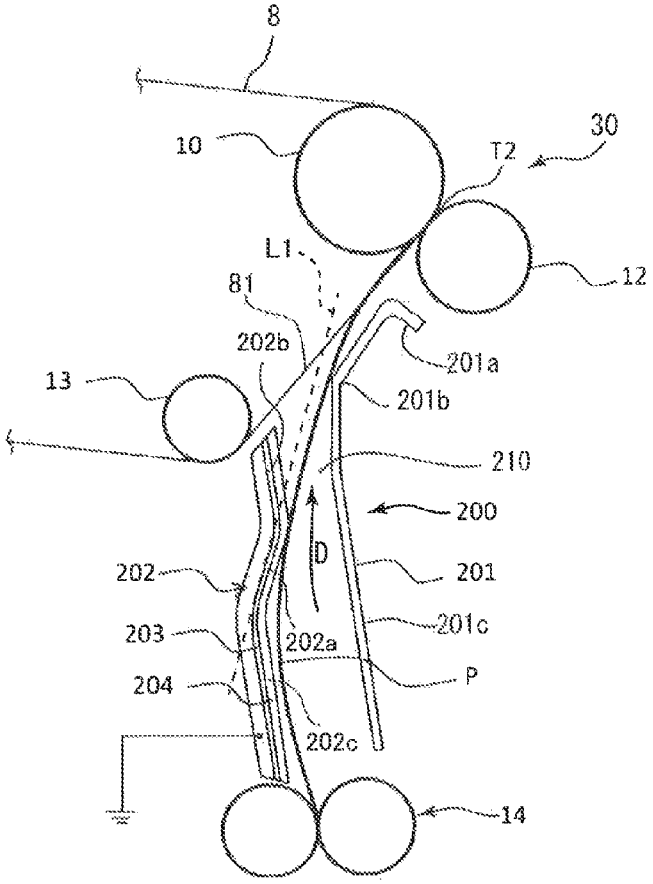
FIG. 2A is a schematic diagram illustrating a configuration of a secondary transfer portion and its vicinity of the present embodiment.
Figure 2B:
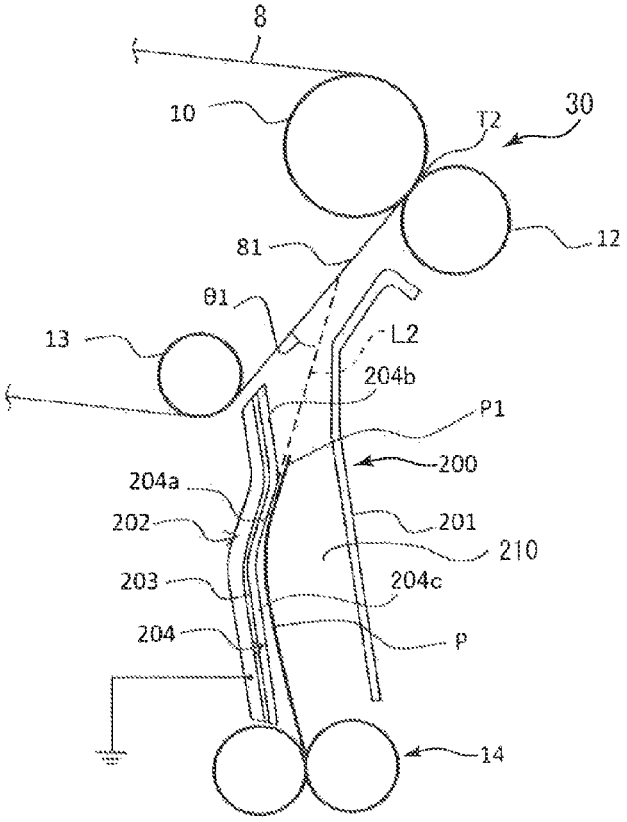
FIG. 2B is a schematic diagram illustrating an angle formed between an extension line of a first guide surface of a cover film and a plane part of an intermediate transfer belt according to the present embodiment.
Figure 3:
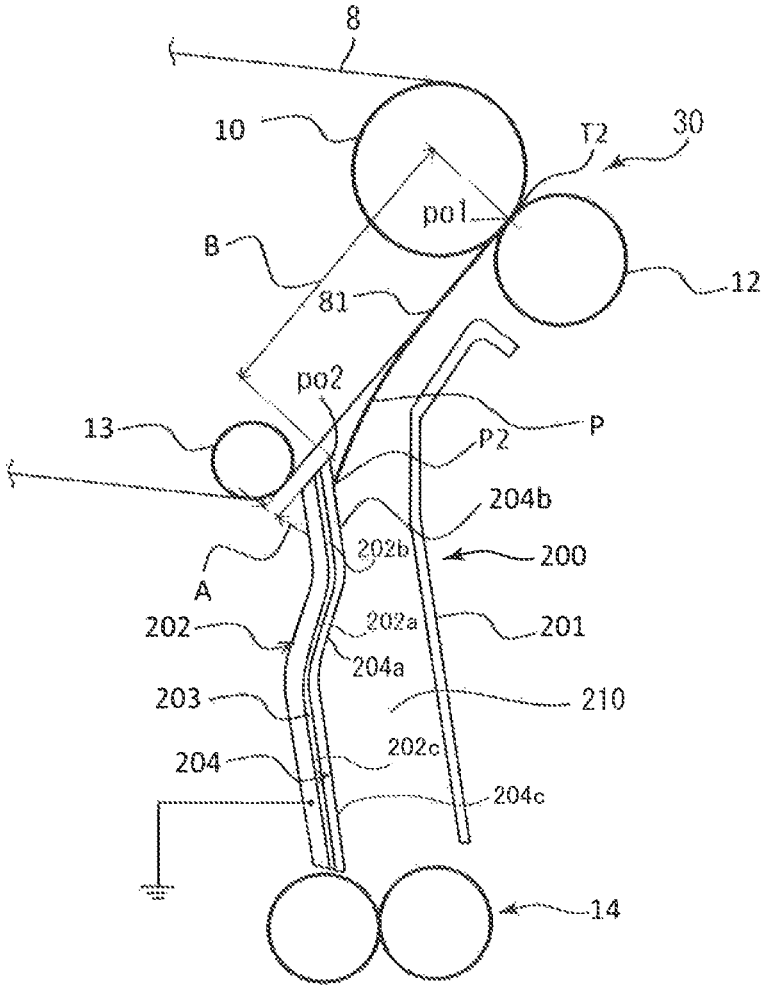
FIG. 3 is a schematic diagram illustrating a state in which a rear end of a sheet is guided toward the secondary transfer portion according to the present embodiment.

As shown in FIGS. 2A and 2B, a registration roller pair 14 is disposed at upstream in a sheet conveying direction (in a direction of an arrow D) of the secondary transfer portion 30. A sheet guide mechanism 200 guiding the sheet P conveyed from the registration roller pair 14 toward the secondary transfer portion 30 is provided in a section from the registration roller pair 14 to the secondary transfer portion 30.

The guide mechanism (sheet guide portion) 200 includes an outer guide member 201, an inner guide member 202 disposed inside of the apparatus body 100*a* so as to face the outer guide member 201, and a cover film member 204 (conductive portion) provided on the inner guide member 202. The inner guide member 202 is a resin member made of an earthed resin. That is, the cover film member 204, i.e., the conductive portion, is provided on the inner guide member 202 so as to be earthed through the inner guide member 202. These outer and inner guide members 201 and 202 are fixed within the apparatus body 100*a* through a support member (not shown).

An adequate space is provided between the outer and inner guide members 201 and 202 so that the sheet P can be conveyed smoothly from the registration roller pair 14 to the secondary transfer portion 30. This arrangement makes it possible to guide the sheet P to the secondary transfer portion 30 between the space thereof while being restricted by the outer and inner guide members 201 and 202. The outer and inner guide members 201 and 202 are formed such that widthwise size thereof orthogonal to the sheet conveying direction D is longer than widthwise size of the sheet P to be conveyed.

The outer guide member 201 is composed of a conductive metal plate for example and includes a bent portion 201*a* bent in a direction away from the intermediate transfer belt 8 at a region right upstream of the secondary transfer outer roller 12. The outer guide member 201 also includes a curve portion 201*b* curved from the bent portion 201*a* to upstream in the sheet conveying direction D, and an extension part 201*c* extending from the curve portion 201*b* further to upstream. The outer guide member 201 is curved at the curve portion 201*b* so that the outer guide member 201 runs roughly along the intermediate transfer belt 8 and can guide the sheet along the extension portion 201*c* and the intermediate transfer belt 8 without using another member.

The inner guide member 202 is disposed on a same side with the intermediate transfer belt 8 with respect to a conveying path 210 formed of the outer guide member 201 and the cover film member 204 and guiding the sheet to the secondary transfer portion 30. The inner guide member 202 includes a first straight surface 202*c* extending substantially in parallel with the extension portion 201*c* of the outer guide member 201, a flexed surface 202*a* (first surface) extending from a downstream end of the first straight surface 202*c* in a direction approaching to the outer guide member 201, and a second straight surface 202*b* (second surface) extending from a downstream end of the flexed surface 202*a* substantially in parallel with the first straight surface 202*c*. The first straight surface 202*c*, the flexed surface 202*a*, and the second straight surface 202*b* extend along the sheet conveying direction. As shown in FIG. 2A, the flexed surface 202*a* is formed such that an extension line L1 thereof intersects with a flat part 81 (described later) of the intermediate transfer belt 8. The second straight surface 202*b* extends so as to be away from the extension line L1 of the flexed surface 202*a* in a direction of thickness of the sheet.

The sheet-like conductive cover film member 204 is pasted on the inner guide member 202 across whole surfaces of the first straight surface 202*c*, the flexed surface 202*a* and the second straight surface 202*b* by a conductive double-sided tape 203 (adhesive portion). It is noted that the cover film member 204 need not be always provided across the whole surfaces of the inner guide member 202 as long as the cover film member 204 is provided to be conductive to the inner guide member 202 in an area slidingly contactable with the sheet P in the inner guide member 202. Thus, the cover film member 204 is pasted on the inner guide member 202 by the conductive double-sided tape 203 (adhesive tape), so that it becomes very easy to perform the process of pasting the cover film member 204.

The inner guide member 202 is formed of a high-resistant resin member for example. The cover film member 204 is formed of a conductive resin film for example and its volume resistivity is set to be lower than that of the inner guide member 202. The inner guide member 202 is earthed (frame ground) to the apparatus body 100*a* side. Thus, the inner guide member 202 guiding the sheet P to the secondary transfer portion 30 is composed of the earthed resin member made of resin.

By the way, if an insulative member is provided instead of the conductive cover film member 204, there is such a possibility that a surface of the insulative member is electrified by sliding friction between the insulative member and the sheet P, thus affecting a surface charge of the sheet P and causing unevenness of an image due to defective transfer. In contrast, because the conductive cover film member 204 is provided in the present embodiment, the surface charge of the cover film member 204 in contact with the sheet P is evenly and homogeneously distributed. This arrangement makes it possible to suppress unevenness of charge on the surface of the sheet otherwise caused by the sliding friction (contact) between the cover film member 204 and the sheet P. Thereby, the sheet P is hardly influenced by the unevenness of charge and the unevenness of transfer at the secondary transfer portion 30 (the transfer nip portion T2) is considerably suppressed.

Specifically, the inner guide member 202 of the present embodiment is molded by using PET (Polyethylene terephthalate) for example whose volume resistivity is around $1\times10^{13}$ Ω·m. The inner guide member 202 is preferable to be composed of a member whose electric resistance value is higher than that of the cover film member 204 and whose volume resistivity is $1\times10^{10}$ Ω·m or more and $1\times10^{13}$ Ω·m or less. In this case, even if electric resistance of the sheet P is lowered in a high-temperature and highly humid environment for example, it is possible to restrain an electric current from otherwise flowing from the secondary transfer outer roller 12 to the inner guide member 202 through the sheet P and to prevent defective image such as transfer omission. Still further, because the inner guide member 202 is composed of the material whose volume resistivity is set to be lower than those of an insulator such as rubber and polyethylene, static electricity generated by the contact, separation and sliding friction between the cover film member 204 and the sheet P increases more than a predetermined voltage and flows to the earthed inner guide member 202 through the cover film member 204 and the conductive double-sided tape 203. This arrangement makes it possible to prevent electronic devices from failing due to the high-voltage static electricity.

In the present embodiment, the cover film member 204 is formed of a polymer polyethylene sheet for example. As the polymer polyethylene sheet, one whose volume resistivity is around $1\times10^{7}$ Ω·m is used. Thus, the cover film member 204 is preferably composed of one whose electrical resistance value is lower than that of the inner guide member 202 and whose volume resistivity is greater than zero and $1\times10^{7}$ Ω·m or less. The cover film member 204 pasted on the inner guide member 202 by the conductive double-sided tape 203 composes a conductive portion. The volume resistivity of the inner guide member 202 as the resin member is set to be higher than that of the cover film member 204.

Next, a shape of the cover film member 204 and a move of the sheet conveyed by the cover film member 204 will be described with reference to FIGS. 2B and 3. That is, FIG. 2B shows a state in which a position of a front end part P1 in the conveying direction of the sheet P is restricted by the inner guide member 202, and FIG. 3 shows a state in which a rear end P2 of the sheet P is guided to the secondary transfer portion 30. As shown in FIG. 2B, the cover film member 204 is pasted on the inner guide member 202 by the conductive double-sided tape 203 and includes a straight surface 204*c* formed along the first straight surface 202*c* of the inner guide member 202, a first guide surface 204*a* formed along the flexed surface 202*a*, and a second guide surface 204*b* formed along the second straight surface 202*b*. The intermediate transfer belt 8 also includes the flat part 81 extending between the stretch roller 13 and the driving roller 10.

The front end part P1 of the sheet P is guided toward the flat part 81 by the first guide surface 204*a* of the cover film member 204. That is, an extension line L2 of the first guide surface 204*a* intersects with the flat part 81 with an angle θ1.

It is noted that the second guide surface 204*b* is provided at downstream in the conveying direction of the first guide surface 204*a*, extends so as to be away in the sheet thickness direction from the extension line L2 of the first guide surface 204*a* as it comes closer to the intermediate transfer belt 8, and guides a rear end of the sheet being transferred in the secondary transfer portion 30 to the intermediate transfer belt 8.

If the angle θ1 is small, an impact caused when the front end part P1 of the sheet P in the conveying direction butts against the flat part 81 can be reduced, and a rotational speed of the intermediate transfer belt 8 can be restrained from fluctuating. Accordingly, it is preferable to set the angle θ1 to be small as much as possible.

FIG. 3 shows a state in which a position of the rear end P2 in the conveying direction of the sheet P is restricted by the inner guide member 202 and is guided to the secondary transfer portion 30. As shown in FIG. 3, the rear end P2 is guided such that the rear end P2 comes in contact with the flat part 81 along the second guide surface 204*b* of the cover film member 204. It is noted that a distance A between an upper end of the inner guide member 202 and the intermediate transfer belt 8 is preferable to be 1.0 mm or more to restrain the toner from scattering.

Still further, if a distance from a contact point po1 of the secondary transfer outer roller 12 with the sheet P to a front end po2 of the cover film member 204 in a direction parallel with the flat part 81 is denoted as a distance B, a returning force caused by deflection of the sheet P when the rear end P2 of the sheet P separates from the second guide surface 204*b* increases if the distance A increases or the distance B decreases. If the returning force of the rear end P2 of the sheet P increases, an abutting force caused when the sheet P comes into contact with the flat part 81 increases, so that disturbance of the toner image is liable to occur at the flat part 81. Therefore, it is preferable to form the inner guide member 202 on which the cover film member 204 is pasted such that the distance A is small as much as possible within the range of 1.0 mm or more and the distance B is large as much as possible while considering spaces occupied by other components.

In the present embodiment, the flexed surface 202*a* of the inner guide member 202 extends such that the extension line L1 thereof intersects with the flat part 81 and approaches to the outer guide member 201. Then, the angle θ1 is formed between the extension line L2 of the first guide surface 204*a* of the cover film member 204 formed along the flexed surface 202*a* and the flat part 81. If the inner guide member 202 is configured so as to extend straightly in parallel with the flexed surface 202*a*, the angle θ1 increases more. Still further, because the second straight surface 202*b* of the inner guide member 202 extends substantially in parallel with the first straight surface 202*c* from the downstream end of the flexed surface 202*a*, the distance B between the front end po2 of the first guide surface 204*a* of the cover film member 204 formed along the second straight surface 202*b* and the contact point po1 of the rollers 10 and 12 increases more than a distance in a configuration in which the inner guide member 202 includes no second straight surface 202*b*.

As described above, according to the present embodiment, the use of the high resistant resin member as the material of the inner guide member 202 makes it possible to restrain the electric current from flowing through the inner guide member 202. Then, the inner guide member 202 is connected to the earth and the cover film member 204 is adhered to the inner guide member 202 so as to be electrically conductive. Still further, the resistance value of the cover film member 204 is set to be lower than that of the inner guide member 202.

Due to that, this arrangement makes it possible to restrain the electric current caused by the voltage applied to the secondary transfer outer roller 12 from flowing to the inner guide member 202 through the sheet P from the secondary transfer outer roller 12 in a state in which the sheet P nipped by the secondary transfer portion 30 is in contact with the cover film member 204. Thereby, it is possible to prevent image quality from dropping due to the defective toner transfer.

Still further, because the electrical resistance of the cover film member 204 is set to be lower than that of the inner guide member 202 and the cover film member 204 is adhered to the inner guide member 202 so as to be electrically conductive, static electricity generated by the contact, peel and sliding friction between the sheet P and the cover film member 204 is homogeneously dispersed on the surface of the cover film member 204. This arrangement makes it possible to restrain the occurrence of the uneven electrification on the surface of the cover film member 204 and the drop of the image quality. Still further, the static electricity generated between the sheet P and the cover film member 204 flows to the earthed inner guide member 202 through the cover film member 204 and the conductive double-sided tape 203 when its voltage rises to a predetermined voltage or more. This arrangement makes it possible to prevent the electric devices from failing due to the high-voltage static electricity.

Still further, because no resistive element such as a variable resistor is necessary while avoiding the uneven electrification on the cover film member 204 by the simple configuration, it is possible to cut the cost and to make the apparatus compact. Still further, because the inner guide member 202 is formed of the resin member, the curved surface shape as described above can be formed accurately at low cost. Thereby, the cover film member 204 pasted on the inner guide member 202 has the surface shape of the first and second guide surfaces 204*a* and 204*b* and the angle θ1 can be set small. Thus, it is possible to restrain misregistration of an image otherwise caused by a change of rotation speed of the intermediate transfer belt 8 due to an impact force when the front end P1 of the sheet P rushes into the intermediate transfer belt 8 and to restrain disturbance of the toner image caused by an impact when the rear end P2 of the sheet P comes into contact with the intermediate transfer belt 8 by prolonging the distance B.

Still further, according to the present embodiment, because the inner guide member 202 is formed of the resin member, it is possible to cut the weight by about a half to one third as compared to a case when the inner guide member 202 is formed of a metal plate. Accordingly, it is possible to reduce weight of the entire apparatus and is preferable as an image forming apparatus such as a home use printer which is desired to save space and weight in particular.

It is noted that while the cover film member 204 is pasted on the inner guide member 202 by the conductive double-sided tape 203 in the present embodiment, another member can be interposed between the conductive tape 203 and the inner guide member 202. In this case, volume resistivity of the other member is preferable to be smaller than that of the inner guide member 202.

Still further, while the resin film is used as the cover film member 204 (conductive portion) in the present embodiment, the present invention is not limited to such configuration. That is, a metal foil, graphite, and others may be used instead of the resin film. Still further, the conductive portion may be configured by applying a conductive coating to the surfaces of the inner guide member 202, e.g., the first straight surface 202*c*, the flexed surface 202*a*, and the second straight surface 202*b*.

While the conductive double-sided tape has been used as the adhesive portion pasting the cover film member 204 on the inner guide member 202 in the present embodiment, the present invention is not limited to such configuration. That is, conductive adhesives or the like can be used instead of the conductive double-sided tape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107691, filed on May 26, 2014 and Japanese Patent Application No. 2015-91964, filed on Apr. 28, 2015, which are hereby incorporated by reference herein in their entirety.

What is claimed is:

1. An image forming apparatus comprising:

a transfer portion transferring a toner image to a sheet;

a sheet guide portion guiding the sheet to the transfer portion, the sheet guide portion including:

a resin member made of resin;

a conductive portion provided to be in contact with the sheet to which the toner image is being transferred by the transfer portion, supported on the resin member, and electrically connected to the resin member, the conductive portion having lower volume resistivity than that of the resin member; and a ground portion configured to be electrically connected to the resin member to ground the resin member, wherein the conductive portion is grounded by passing current from the conductive portion, through the resin member, and to the ground portion.

2. The image forming apparatus according to claim 1, wherein the conductive portion is pasted to the resin member by an adhesive portion.

3. The image forming apparatus according to claim 1, wherein the volume resistivity of the resin member is $1\times10^{10}$ Ω·m or more and $1\times10^{13}$ Ω·m or less.

4. The image forming apparatus according to claim 1, wherein the volume resistivity of the conductive portion is greater than zero and less than $1\times10^{7}$ Ω·m.

5. The image forming apparatus according to claim 3, wherein the volume resistivity of the conductive portion is greater than zero and less than $1\times10^{7}$ Ω·m.

6. The image forming apparatus according to claim 1, wherein the conductive portion is a film pasted on the resin member.

7. The image forming apparatus according to claim 2, wherein the adhesive portion is composed of an adhesive tape having electrical conductivity.

8. The image forming apparatus according to claim 1, wherein the resin member includes a surface, extending along a sheet conveying direction, on which the conductive portion is provided.

9. The image forming apparatus according to claim 1, wherein the conductive portion is a conductive coat applied on a surface of the resin member.

10. The image forming apparatus according to claim 1, wherein the transfer portion includes an intermediate transfer belt carrying a toner image and a transfer roller forming a transfer nip portion nipping a sheet together with the intermediate transfer belt and to which transfer bias is applied.

11. The image forming apparatus according to claim 1, wherein the transfer portion includes an intermediate transfer belt carrying a toner image and a transfer roller forming a transfer nip portion nipping a sheet together with the intermediate transfer belt and to which transfer bias is applied, wherein the sheet guide portion includes an opposing guide member disposed to face the resin member and the resin member is disposed on a same side as the intermediate transfer belt so as to have the conductive portion contact with a surface of the sheet that is to be in contact with the intermediate transfer belt, the resin member including a first surface whose extension line intersects with the intermediate transfer belt and a second surface provided downstream in a sheet conveying direction of the first surface and extending away from the opposing guide member as the second surface approaches the intermediate transfer belt, and wherein the conductive portion is provided along the first and second surfaces.

12. The image forming apparatus according to claim 1, wherein the transfer portion includes an intermediate transfer belt carrying a toner image and a transfer roller forming a transfer nip portion nipping a sheet together with the intermediate transfer belt and to which transfer bias is applied, and wherein the sheet guide portion includes an opposing guide member disposed to face the resin member and the conductive portion includes a first guide surface guiding a front end of the sheet, with respect to a sheet conveying direction, to the intermediate transfer belt and a second guide surface provided downstream in the sheet conveying direction of the first guide surface and extending away from the opposing guide member as the second guide surface approaches the intermediate transfer belt and guiding a rear end of the sheet, with respect to the sheet conveying direction, being transferred by the transfer portion, to the intermediate transfer belt.

13. The image forming apparatus according to claim 1, wherein the conductive portion is provided on the resin member across its whole length.

* * * * *